US005673361A

United States Patent [19]

Ireton

[11] Patent Number: 5,673,361

[45] Date of Patent: Sep. 30, 1997

[54] SYSTEM AND METHOD FOR PERFORMING PREDICTIVE SCALING IN COMPUTING LPC SPEECH CODING COEFFICIENTS

[75] Inventor: Mark A. Ireton, Austin, Tex.

[73] Assignee: Advanced Micro Devices, Inc., Sunnyvale, Calif.

[21] Appl. No.: 556,262

[22] Filed: Nov. 13, 1995

[51] Int. Cl.[6] ..... G10L 9/14

[52] U.S. Cl. ..... 395/2.28; 395/2.25; 395/2.26; 395/2.33; 395/2.34

[58] Field of Search ..... 395/2.25, 2.26, 395/2.28, 2.33–2.35

[56] References Cited

U.S. PATENT DOCUMENTS

| | | | |
|---|---|---|---|
| 4,544,919 | 10/1985 | Gerson . | |
| 4,817,157 | 3/1989 | Gerson . | |
| 4,847,906 | 7/1989 | Ackenhusen | 395/2.26 |
| 4,896,361 | 1/1990 | Gerson . | |

OTHER PUBLICATIONS

ICASSP 82 Proceedings, May 3, 4, 5, 1982, Palais Des Congres, Paris, France, Sponsored by the Institute of Electrical and Electronics Engineers, Acoustics, Speech, and Signal Processing Society, vol. 2 of 3, IEEE International Conference on Acoustics, Speech and Signal Procesing, pp. 651–654.

*Primary Examiner*—Allen R. MacDonald
*Assistant Examiner*—Alphonso A. Collins
*Attorney, Agent, or Firm*—Conley, Rose & Tayon; Jeffrey C. Hood

[57] ABSTRACT

A system and method for calculating linear predictive coding (lpc) coefficients in response to a received speech signal waveform. The system of the present invention uses a method referred to as the FLAT method for computing the lpc coefficients. The FLAT method involves computing 10 lpc filter coefficients and proceeds in a succession of iterations, wherein the 10 filter coefficients are derived in part from 10 reflection coefficients. According to the present invention, the method determines or predicts a scaling factor and, during each iteration, applies the scaling factor to the matrix terms prior to storage of the data while the full precision value is still available internally. Thus the present invention maintains full precision for the speech data during the computation. The scale factor prediction method of the present invention is most effective for high power voiced speech where the greatest loss of precision occurs using prior art post-storage scaling techniques.

17 Claims, 9 Drawing Sheets

Representation of Speech Signals

Range of bit rates for various types of speech representations.

Source-system model of speech production

General discrete-time model for speech production

Block diagram of simplified model for speech production

SYSTEM AND METHOD FOR PERFORMING PREDICTIVE SCALING IN COMPUTING LPC SPEECH CODING COEFFICIENTS

FIELD OF THE INVENTION

The present invention relates generally to voice coders (vocoders), and more particularly to a system and method for computing LPC (linear predictive coding) coefficients using predictive scaling techniques to maintain greater precision and accuracy.

DESCRIPTION OF THE RELATED ART

Digital storage and communication of voice or speech signals has become increasingly prevalent in modern society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

A widely used model for speech production assumes that the vocal tract can be represented as a concatenation of lossless acoustic tubes. A value referred to as the reflection coefficient represents the mount of traveling waves reflected at the junction of two tubes.

Background on voice encoding and decoding methods which use parametric representations of speech signals is deemed appropriate. A speech storage system first receives input voice waveforms and converts the waveforms to digital format. This involves sampling and quantizing the signal waveform into digital form. The voice encoder within the system then partitions the digital voice data into respective frames and analyzes the voice data on a frame-by-frame basis. The voice encoder then generates a plurality of parameters which describe each particular frame of the digital voice data.

Linear predictive coding is often used in analyzing speech signals and representing the speech signals as a plurality of coefficients or parameters. The basic idea behind linear predictive analysis is that a speech sample can be approximated as a linear combination of past speech samples. Linear predictive coding involves generating a unique set of predictor coefficients which are used as the weighting coefficients in the linear combination. Therefore, a common component of modern digital speech processing algorithms is the derivation of a set of "LPC filter coefficients." These coefficients model the acoustic effect of the mouth above the Glottis (vocal cords).

One particularly successful way of computing these coefficients is referred to as the "Burg algorithm" which is well-known. For more information on the Burg algorithm, please see J. Burg, "A New Analysis Technique for Time Series Data," Proc. NATO Advanced Study Institute or Signal Proc., Enschede Netherlands, 1968. Please also see Rabiner and Schafer, *Digital Processing of Speech Signals*, Prentice Hall, 1978.

A particularly efficient mechanism for implementing the Burg algorithm is referred to as the "FLAT algorithm." For more information on the Flat algorithm, please see U.S. Pat. No. 4,544,919 titled "Method & Means of Determining Coefficients for Linear Predictive Coding," which issued on October 1985 and whose inventor is Ira Gerson. The Flat algorithm is also discussed in Camani, "On a Covariance-Lattice Algorithm for Linear Prediction," Proc. IEEE Int. Conf. on Acoustics, Speech & Signal Processing, pp 651–654, May 1982.

The FLAT algorithm involves computing a plurality of filter coefficients which are derived in part from a plurality of reflection coefficients. The FLAT algorithm proceeds in a succession of iterations which involves updating the values or elements in respective matrices, based on the computed reflection coefficient, to obtain the filter coefficients. In the FLAT algorithm, the first reflection coefficient is derived and used in a first iteration to update elements in the respective matrices, and then the next reflection coefficient is derived and the second iteration on the matrix elements is performed, and so on. Thus, at the start of each iteration, a "reflection coefficient" is computed and used during the remainder of the iteration. The filter coefficients are thus obtained with a plurality of iterations of matrix updates.

The reflection coefficient, denoted as k, is a filter term that defines the correlation of the voice signal and has a direct correlation to the gain of the signal. Every time a reflection coefficient is computed, the matrix equations are updated to represent the effect of the reflection indicated by the reflection coefficient being removed from the signal at the input. Each iteration removes correlation from the signal and thus effectively removes power from the signal. In other words, when the effect of the reflection coefficient is removed for a subsequent iteration, gain is also removed from the signal, wherein the gain is $$\frac{1}{1-k^2}.$$

Thus each iteration scales down the input signal, sometimes substantially. In some cases the input signal loses 3 or 4 bits of precision per iteration.

Traditional mechanisms for coping with this scaling problem rely on storing the results and then, after all of the results are computed and stored, analyzing the scale of the data and rescaling as appropriate. The reseating involves determining the number of most significant bits that are not used, and then scaling the numbers upward to use all of the available bits. This results in a loss of precision that can not be recovered, since the values for the least significant bits will be all zeros. Alternatively, double precision values can be stored so that full precision values can be recovered by scaling. However, this requires a larger memory for storing additional bits of precision for the voice parameter data. In cost sensitive systems, this additional memory is undesirable. Therefore, neither of the above approaches are particularly satisfactory as the former loses precision and the latter requires extra memory.

Therefore, one problem with the FLAT algorithm for implementation in a fixed point architecture is that, as the computation proceeds, the magnitudes of the data being processed are reduced in a heretofore unpredictable manner. The loss in precision or reduction in gain can be as much as 8 bits and can lead to the generation of unstable filters. Further, the reduction in gain is the greatest for the most important, high powered voiced portions of the speech signal. The traditional approach of storing the data and then rescaling the data to offset this reduction in gain still results in a loss of data precision that cannot be recovered.

Therefore, an improved system and method for computing lpc coefficients is desired which provides greater precision for the speech data and which does not require greater memory requirements for double precision storage.

SUMMARY OF THE INVENTION

The present invention comprises a system and method for computing linear predictive coding coefficients using the FLAT method with increased precision. The system and method determines or predicts a scaling factor before computation of the lpc coefficients and applies the scaling prior to storage of the data while the full precision value is still available internally. Thus the present invention maintains full precision for the voice or speech data during the computation. The scaling factor prediction method of the present invention is most effective for high power voiced speech where the greatest loss of precision occurs using prior art post-storage scaling techniques and where the consequences of error are greatest.

The system comprises a voice coder/decoder which preferably includes a digital signal processor (DSP) or other hardware. During encoding of the voice data, the voice coder/decoder receives voice input waveforms and codes the data to generate a parametric representation of the voice data. First, voice input waveforms are received and converted into digital data, i.e., the voice input waveforms are sampled and quantized to produce digital voice data. The digital voice data is then partitioned into a plurality of respective frames, and coding is performed on respective frames to generate a parametric representation of the data, i.e., to generate a plurality of parameters which describe the respective frames of voice data. During the coding process, the voice coder/decoder generates a plurality of lpc (linear predictive coding) coefficients which correspond to the vocal tract model.

The system of the present invention uses a method referred to as the FLAT method for computing the lpc coefficients. The FLAT method involves computing 10 filter coefficients and proceeds in a succession of iterations. The 10 filter coefficients are derived in part from 10 reflection coefficients. The method involves deriving a first reflection coefficient and using this coefficient in a first iteration to update respective matrices, and then deriving the next reflection coefficient, and so on. Thus, at the start of each iteration, a "reflection coefficient" is computed and used during the remainder of the iteration.

Each time a reflection coefficient is computed, respective matrix terms are updated to represent the effect of the reflection being removed from the signal at the input, wherein the effect of the reflection is indicated by the reflection coefficient. According to the present invention, a predicted scaling factor is applied to the matrix terms prior to storage of the updated terms. Thus the predicted scaling factor compensates for the loss in gain caused by the iteration prior to storage of the data, while the full precision value is still available internally. Therefore, the present invention substantially prevents any loss of precision.

In the preferred embodiment, the scaling factor is applied during the computation or iteration on each of the matrix terms. During each iteration, the system of the present invention computes various iteration factors that are then multiplied with each of the matrix terms during the iteration. In the preferred embodiment, the system performs scaling on the iteration factors during the computation process, and then multiplies the scaled iteration factors with the matrix terms during the iteration. This effectively scales the matrix terms. In other embodiments, the present invention performs scaling on the matrix terms prior to or after the iteration. As noted above, prior art systems perform scaling after the data is truncated and stored, thus losing precision for the data. In the present invention, the scaling is predicted and applied prior to storage, thus maintaining substantially full precision.

The system preferably uses a predicted scaling factor of $$\frac{.8}{1-k^2}.$$

The preferred embodiment also includes a secondary scaling factor which provides supplemental scaling in cases where the predicted scaling factor does not fully scale the matrix terms. The preferred embodiment further includes a guard scaling value or guard bit which prevents over-scaling from occurring.

A system according to the present invention includes a memory which stores the matrix terms as well as any computed iteration factors. The system also preferably includes a means for computing a gain or scaling factor according to the equation $$\frac{.8}{1-k^2}.$$

A normalization block receives the scaling factor and produces a multiplication factor and a shift factor value. Thus the normalization block places the gain in a format where the gain is less than one (between 0.5 and 1) and includes a shift.

The multiplication factor output from the normalization block is provided to a multiplication block or multiplier. The multiplier also receives data values of the respective matrices from the memory and multiplies the multiplication factor with the data values. The output of the multiplication block is a partially scaled data value, which is provided to a barrel shifter.

The shift value output from the normalization block is provided to an adder. The adder also receives a secondary scaling factor and a −1 value, referred to as a guard bit. The secondary scaling factor operates to provide an additional shift where a larger scaling factor than $$\frac{.8}{1-k^2}$$

is desired. In instances where the scaled matrix term value is larger than desired, i.e., too much scaling was performed, the increase in value is prevented from causing an overflow by the guard bit. The adder outputs a barrel shifter control value to the barrel shifter. The barrel shifter shifts the partially scaled data value according to the barrel shifter control value and outputs a fully scaled data value.

In the preferred embodiment, as discussed above, the system performs scaling on iteration factors which are then multiplied with the matrix term data values, thus effectively scaling the matrix term data values. Thus, in the preferred embodiment, the system receives iteration factors from the memory and produces scaled iteration factors. In this embodiment, the scaled iteration factors are then used during the iteration and operate to scale the matrix term values during the iteration.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Incorporation by Reference

The following references are hereby incorporated by reference.

For information on the Burg method, please see Burg, "A New Analysis Technique for Time Series Data," Proc. NATO Advanced Study Institute on Signal Processing, Enschede Netherlands, 1968, which is hereby incorporated by reference in its entirety.

For more information on the "FLAT algorithm", please see U.S. Pat. No. 4,544,919 titled "Method & Means of Determining Coefficients for Linear Predictive Coding," which issued on October 1985 and whose inventor is Ira Gerson, and which is hereby incorporated by reference in its entirety. Please also see Camani, "On a Covariance-Lattice Algorithm for Linear Prediction," Proc. IEEE Int. Conf. on Acoustics, Speech & Signal Processing, pp 651–654, May 1982, which is hereby incorporated by reference in its entirety.

For general information on speech coding, lpc coding and the Burg algorithm, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 1:
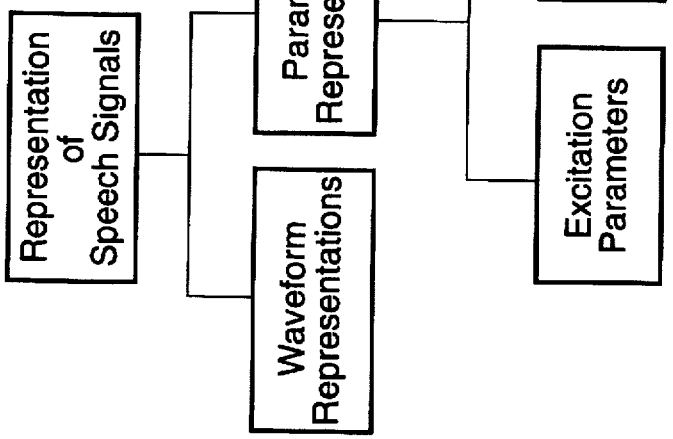
FIG. 1 (prior art)
FIG. 1 illustrates waveform representation and parametric representation methods used for representing speech signals.
Figure 2:
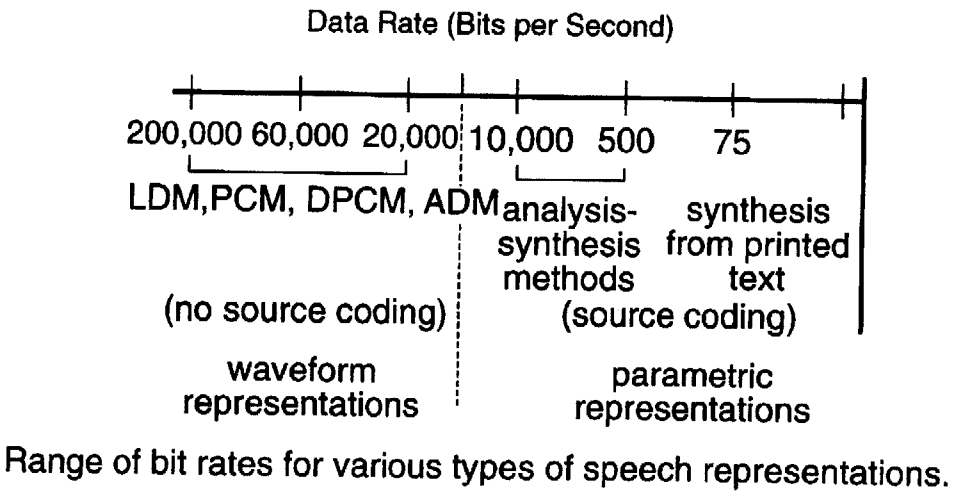
FIG. 2 (prior art)
FIG. 2 illustrates a range of bit rates for the speech representations illustrated in FIG. 1.
Figure 3:
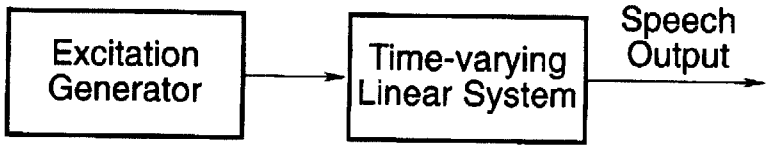
FIG. 3 (prior art)
FIG. 3 illustrates a basic model for speech production.
Figure 4:
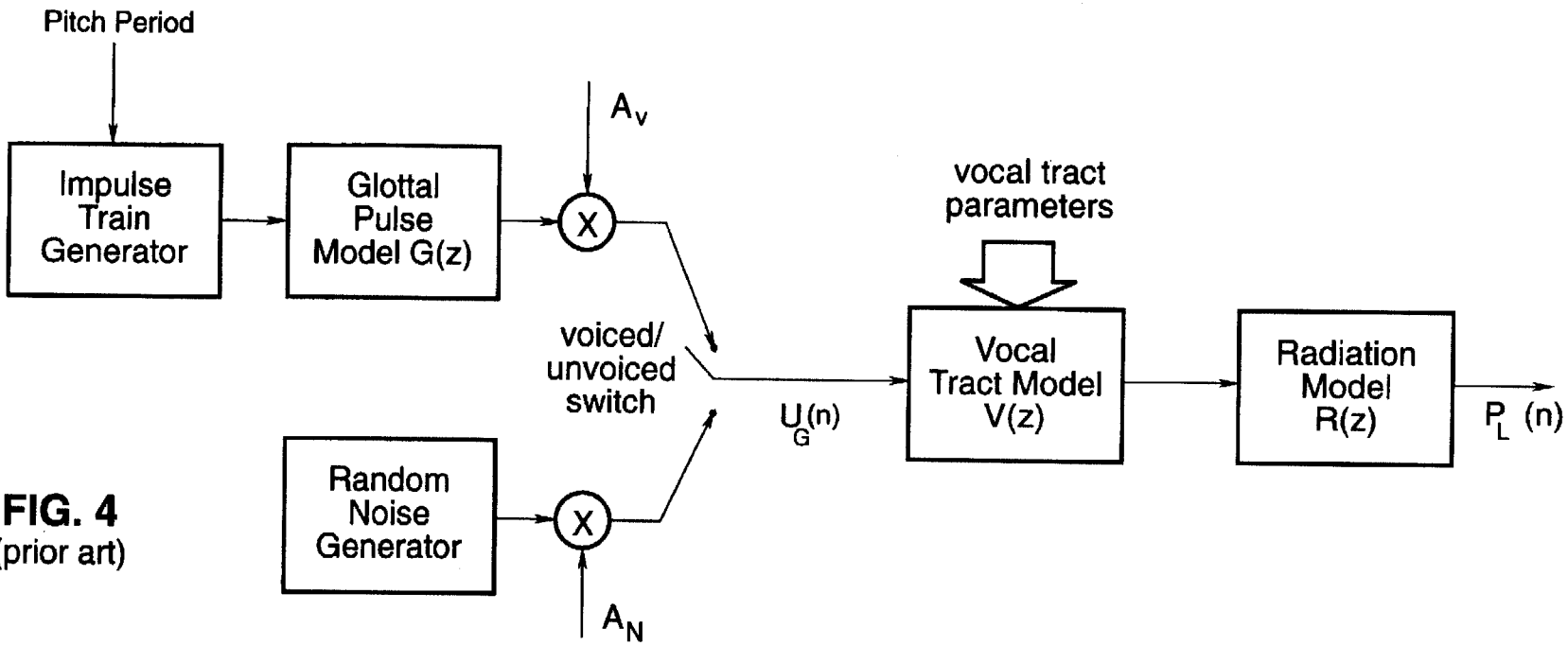
FIG. 4 (prior art)
FIG. 4 illustrates a generalized model for speech production.
Figure 5:
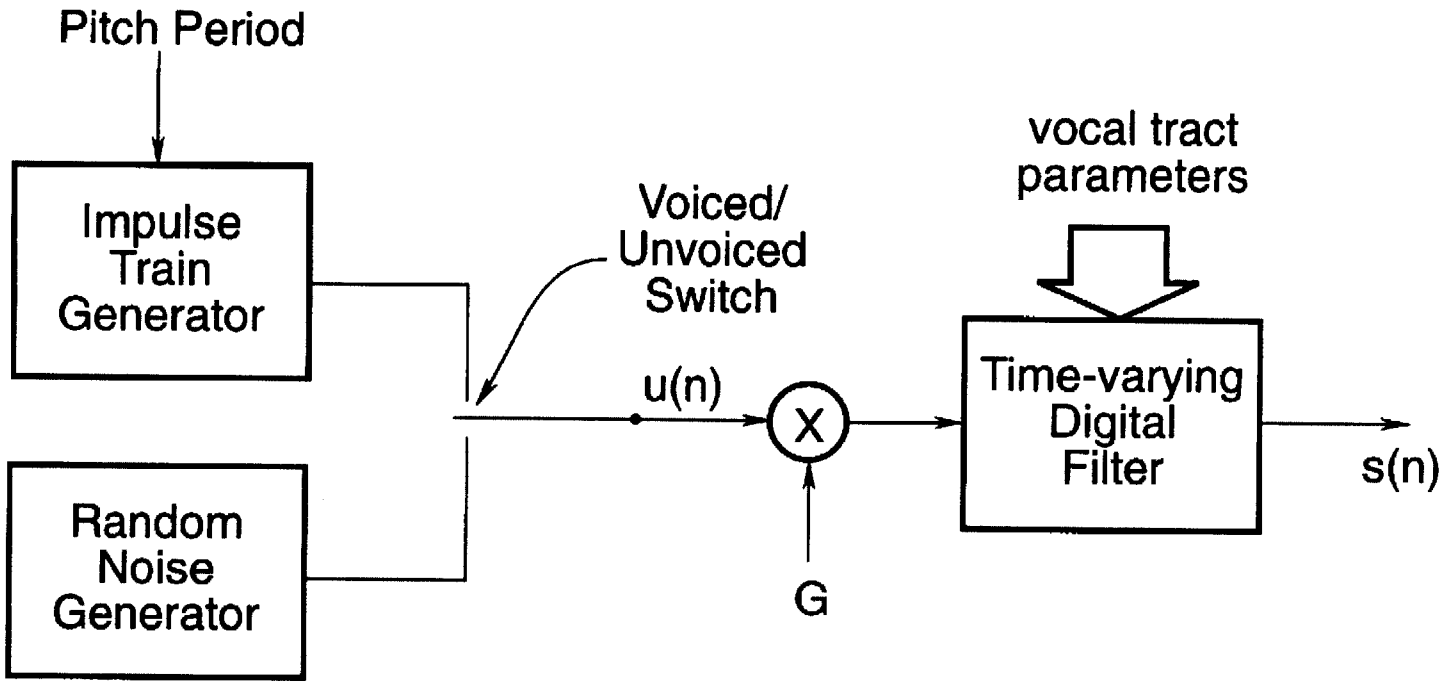
FIG. 5 (prior art)
FIG. 5 illustrates a model for speech production which includes a single time-varying digital filter.
Figure 6:
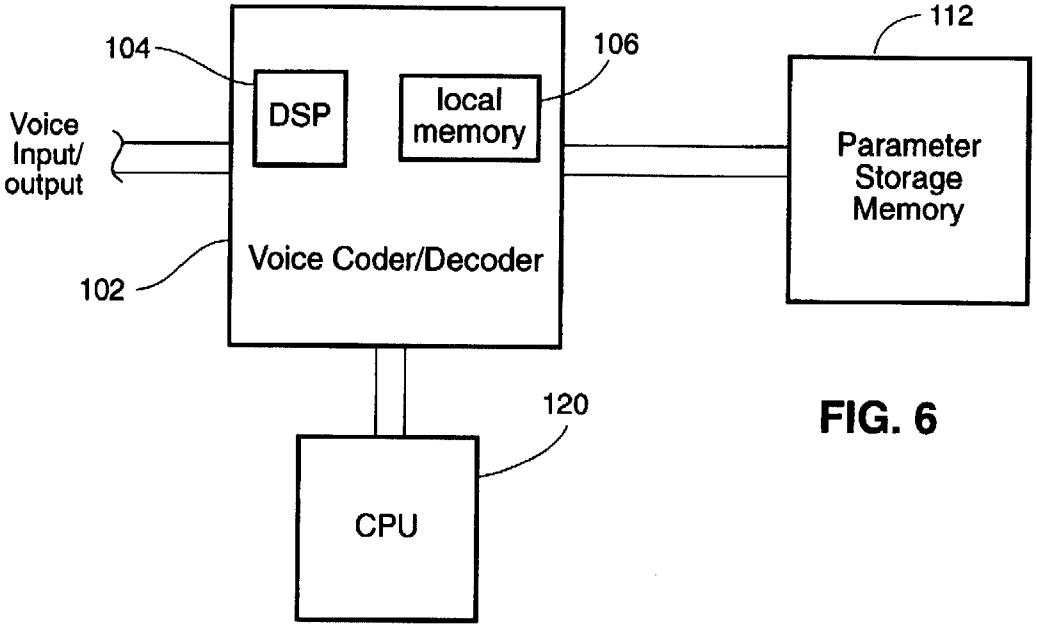
FIG. 6 is a block diagram of a speech storage system according to one embodiment of the present invention.

Referring now to FIG. 6, a block diagram illustrating a representative voice storage and retrieval system according to one embodiment of the invention is shown. The system of FIG. 6 is illustrative only, and various other types of configurations may be used, as desired. Also, the present invention may be incorporated into various types of voice processing or voice coding systems or applications, as desired. The voice storage and retrieval system shown in FIG. 6 can be used in various applications, including digital answering machines, digital voice mail, digital voice recorders, call servers, and other applications which require storage and retrieval of digital voice data. In the preferred embodiment, the voice storage and retrieval system is used in a digital telephone answering machine.

As shown, the voice storage and retrieval system preferably includes a dedicated voice coder/decoder 102. The voice coder/decoder 102 preferably includes a digital signal processor (DSP) 104 and preferably includes local DSP memory 106. The local memory 106 preferably serves as an analysis memory used by the DSP 104 in performing voice coding and decoding functions, i.e., voice compression and decompression, as well as parameter data smoothing. In the preferred embodiment, 2 Kbytes of local memory 106 are used.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

The voice coder/decoder 102 preferably stores data in 16 bit values. However, the voice coder/decoder 102 may store data in other bit quantities, such as 32 bits, 64 bits, or 8 bits, as desired.

Alternate Embodiment

Figure 7:
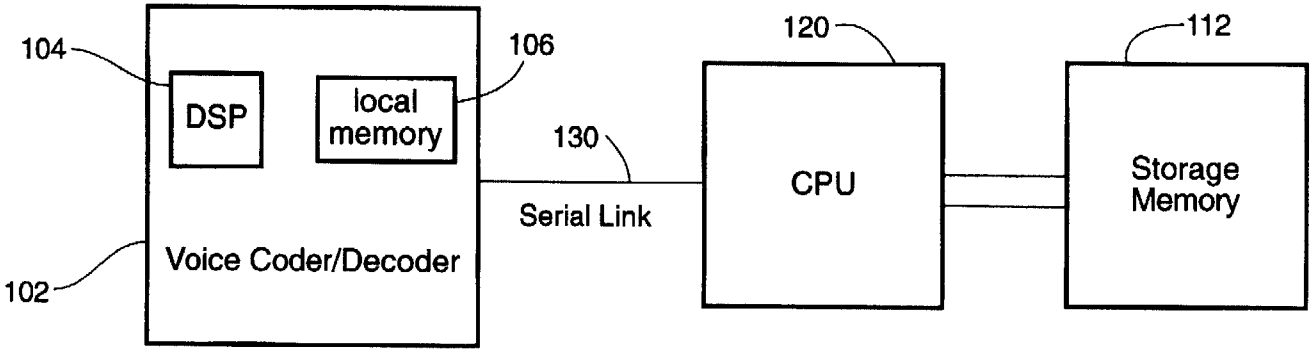
FIG. 7 is a block diagram of a speech storage system according to a second embodiment of the present invention.

Referring now to FIG. 7, an alternate embodiment of the voice storage and retrieval system is shown. Elements in FIG. 7 which correspond to elements in FIG. 6 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 7 can also more closely resemble the embodiment of FIG. 6 whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120. The present invention may be incorporated into various other systems, as desired.

Encoding Voice Data

Figure 8:
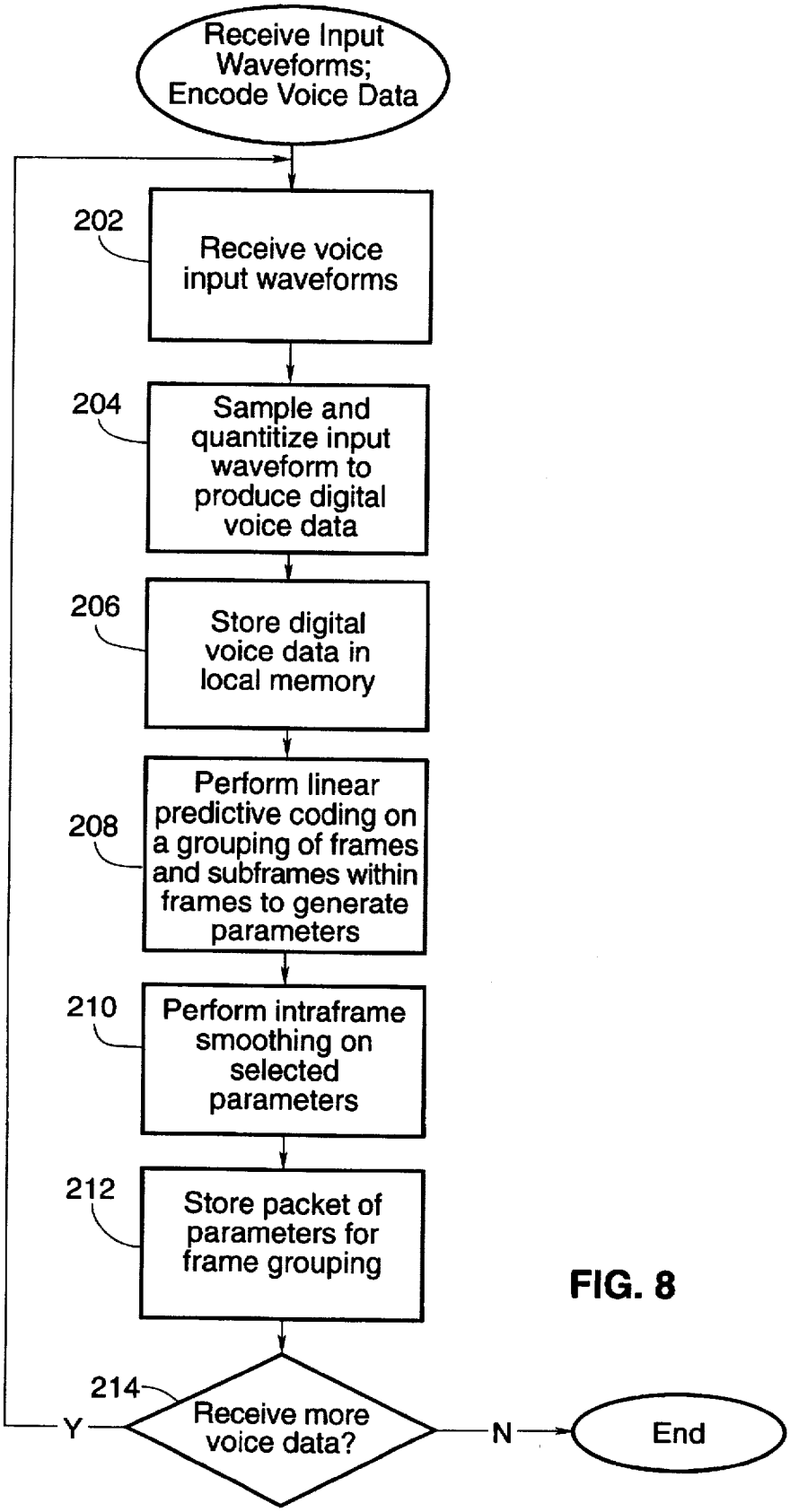
FIG. 8 is a flowchart diagram illustrating operation of speech signal encoding according to one embodiment of the invention.

Referring now to FIG. 8, a flowchart diagram illustrating operation of a voice processing system, such as the system of FIG. 6, encoding voice or speech signals into parametric data is shown. In step 202 the voice coder/decoder 102 receives voice input waveforms, which are analog waveforms corresponding to voice, including speech. In the present disclosure, the term "voice" includes speech and other sounds produce by humans.

In step 204 the DSP 104 samples and quantizes the input voice waveforms to produce digital voice data. The DSP 104 samples the input waveform according to a desired sampling rate. In one embodiment, the speech signal waveform is sampled at a rate of 8 kHz or 8000 samples per second. In an alternate embodiment, the sampling rate is twice the Nyquist sampling rate. Other sampling rates may be used, as desired. After sampling, the speech signal waveform is then quantized into digital values using a desired quantization method. In step 206 the DSP 104 stores the digital voice data or digital waveform values in the local memory 106 for analysis by the DSP 104.

While additional voice input data is preferably being received, sampled, quantized, and stored in the local memory 106 in steps 202–206, the following steps are performed. In step 208 the DSP 104 encodes the voice data into a number of parameters for storage, i.e., generates a parametric representation of the data. The encoding step includes linear predictive coding and includes an improved method for generating lpc coefficients according to the present invention.

The DSP 104 preferably performs encoding on a grouping of frames of the digital voice data to derive a set of parameters which describe the voice content of the respective flames being examined. Linear predictive coding is preferably performed on groupings of four flames. However, it is noted that a greater or lesser number of frames may be encoded at a time, as desired. For more information on digital processing and coding of speech signals, please see Rabiner and Schafer, *Digital Processing of Speech Signals*, Prentice Hall, 1978, referenced above.

The DSP 104 preferably examines the voice signal waveform in 20 ms flames for analysis and coding into respective parameters. With a sampling rate of 8 kHz, each 20 ms flame comprises 160 samples of data. The DSP 104 preferably examines four 20 ms frames at a time where each frame overlaps neighboring frames by five samples on either side, that producing 170 samples for each flame. The local memory 106 is preferably sufficiently large to store up to six full frames of digital voice data. This allows the DSP 104 to examine a grouping of four frames and generate parameters for this grouping of four frames while up to an additional two frames are received, sampled, quantized and stored in the local memory 106. The local memory 106 is preferably configured as a circular buffer where newly received digital voice data overwrites voice data from which parameters have already been generated and stored in the storage memory 112.

In the preferred embodiment, in step 208 the DSP 104 develops a set of parameters of different types for each 20 ms frame in the grouping of four flames. The DSP 104 also generates one or more parameters which span the entire four flames. In addition, for certain parameters, the DSP 104 partitions the respective frames into two or more sub-frames and generates corresponding two or more parameters of the same type for each frame. The DSP 104 generates a plurality of linear predictive coding (lpc) parameters for each frame, preferably ten lpc parameters for each frame. The DSP 104 also generates additional parameters for each flame which represent the characteristics of the speech signal, including a pitch parameter, a voice/unvoice parameter, a gain parameter, a magnitude parameter, and a multi-band excitation parameter. The DSP 104 further derives a spectral content parameter which spans a grouping of four frames.

In step 208 the DSP 104 generates lpc parameters with increased precision according to the present invention, as described below. It is noted that various types of encoding techniques or methods may be used in step 208, as desired. Further, any of various lpc coding methods that are consistent with the present invention may be used, as desired.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. The intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. Once parametric data corresponding to a respective grouping of flames has been generated and stored in the storage memory 112, newly received data eventually overwrites this data in the circular buffer in step 206, and thus the digital voice data for this grouping of frames is removed from the local memory 106 and hence "thrown away."

If more voice or speech waveform data is being received by the voice coder/decoder 102 in step 214, then operation returns to step 202, and steps 202–214 are repeated. Thus, once a set of parameters has been generated for a grouping of flames and stored in the storage memory 112, the DSP 104 examines the next grouping of frames stored in local memory 106 and generates a plurality of parameters for this grouping, and so on. If no more voice data is determined to have been received in step 214, and thus no more digital voice data is stored in the local memory 106, then operation completes.

The flowchart of FIG. 8 is intended to illustrate an exemplary system which performs speech coding, i.e., which receives voice signals and generates a parametric representation of the voice signals. It is noted that the present invention is performed during a portion of step 208. The other steps of FIG. 8 may be performed in any of various ways using various desired methods.

Figure 9:
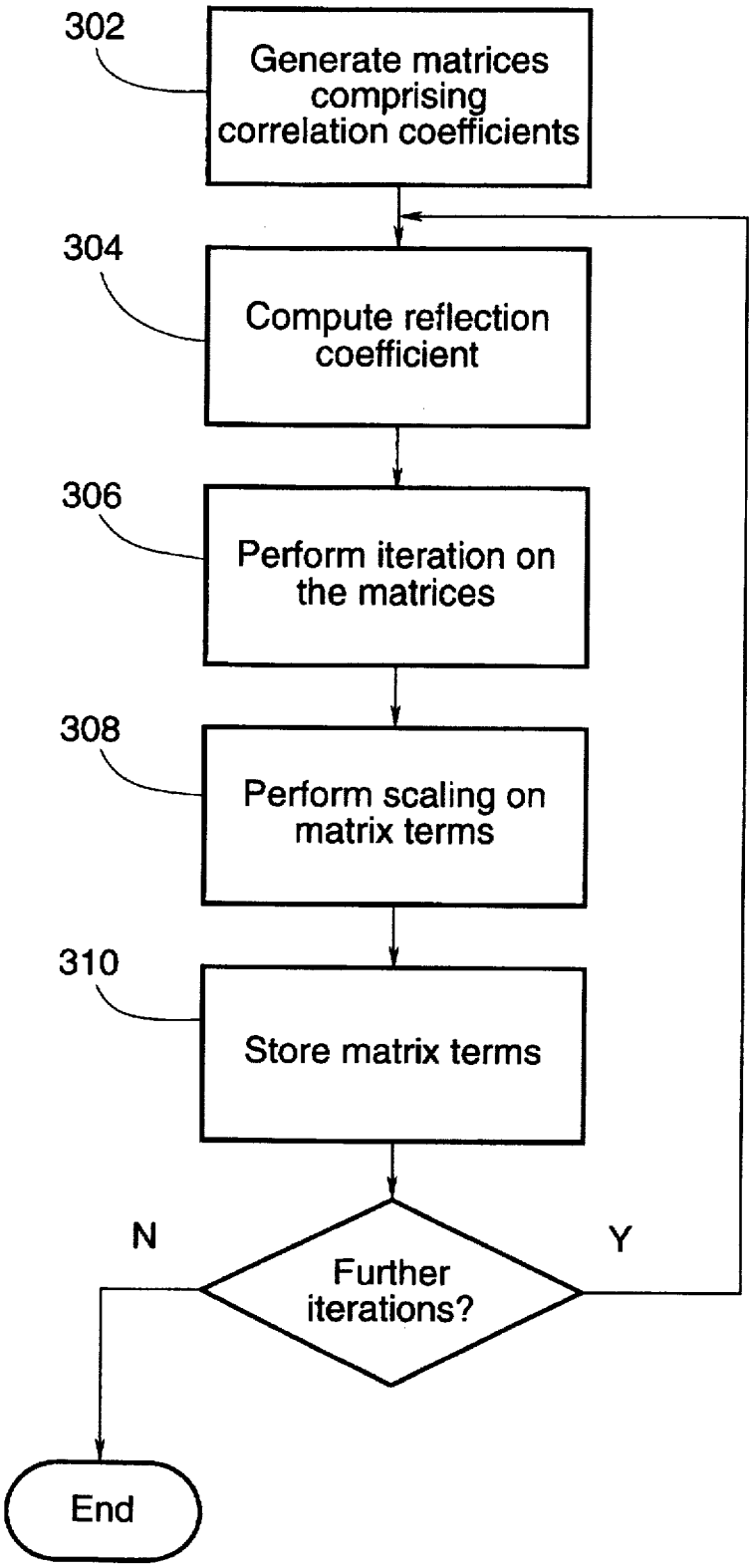
FIG. 9 is a flowchart diagram illustrating computation of lpc coefficients with increased precision according to one embodiment of the present invention.

FIG. 9—Predictive Scaling Method

Referring now to FIG. 9, a flowchart diagram is shown illustrating a portion of the voice coding process. The voice coding steps shown in FIG. 9 perform a method referred to as the FLAT algorithm, and these steps generate lpc parameters with increased precision according to the present invention.

As described in the background section, the FLAT algorithm involves computing 10 filter coefficients and proceeds in a succession of iterations. The 10 filter coefficients are derived in part from 10 reflection coefficients. The first reflection coefficient is derived and used in a first iteration to update respective matrices, and then the next reflection coefficient is derived, and so on. Thus, at the start of each iteration, a "reflection coefficient" is computed and used during the remainder of the iteration. Therefore, 10 filter coefficients are obtained with 9 iterations of matrix updates. The reflection coefficient, denoted as k, is a filter term that defines the correlation of the signal and has a direct correlation to the gain of the signal. When the effect of the reflection coefficient is removed for a subsequent iteration, gain is also removed from the signal. The gain is $$\frac{1}{1-k^2}.$$

The flowchart of FIG. 9 illustrates only a portion of the steps performed in step 208 of FIG. 8, and other steps may be performed in step 208, as is known in the art. The present invention comprises predicting a scaling factor and performing the scaling either before, during or after the matrix iterations and prior to storage of the data, thus producing data with increased precision.

In step 302 the DSP 104 computes one or more matrices comprising correlation coefficients for the speech signal. The matrices are used for generating lpc coefficients which model the vocal tract, i.e., the acoustic effect of the mouth above the glottis. Each of the matrix terms comprise correlation coefficients. The DSP 104 preferably computes 3 matrices, including a forward (F) matrix, a backward (B) matrix, and a current (C) matrix.

In step 304 the DSP 104 computes a reflection coefficient referred to as k. As described in the background section, a widely used model for speech production assumes that the vocal tract can be represented as a concatenation of lossless acoustic tubes. The reflection coefficient represents the amount of traveling waves reflected at the junction of two tubes.

In step 306 the DSP 104 performs an iteration on terms in the matrices using the reflection coefficient. This iteration involves updating the terms in each of the matrices to account for the reflection coefficient, as is known in the art. The reflection coefficient operates to remove power or gain from the signal at the input, and thus each iteration removes correlation from the signal and thus effectively removes power from the signal. Thus each iteration scales down the input signal, sometimes substantially. In some cases the input signal loses 3 or 4 bits of precision per iteration. It is noted that values that are to be scaled are contained as elements in three matrices. Each element of the matrices must have the same relative scale as all of the others in order for processing to be efficient.

In step 308 the DSP 104 performs scaling on the matrix terms using a predicted scaling factor. In the preferred embodiment, the scaling factor is $$\frac{.8}{1-k^2}.$$

However, it is noted that other predicted scaling factors may be used, as desired. Also, a secondary scaling factor and a guard bit are also included in the total scaling factor, as described below.

Experimentation has shown the $$\frac{1}{1-k^2}$$

is an accurate predictor of the true scale factor for magnitude reduction induced by the current iteration. Experiments have also shown that if $$\frac{1}{1-k^2}$$

is used as a scaling factor, then the ratio of the maximum output on the current iteration to the maximum output on the previous iteration is in the range 0.5 to 1.5 and in the vast majority of cases is in the range 0.7 to 1.25. In the preferred embodiment, the predicted scale factor is $$\frac{0.8}{1-k^2}.$$

This ensures that the output values for the current iteration are only very rarely larger than those for the previous iteration.

The equation $$\frac{1}{1-k^2}$$

actually represents the power loss of the signal. In general, the effect of the signal reflections does not affect the matrix coefficients in exactly the same way as the power loss because the matrix terms represent different parts of the power, and the power is being scaled. However the gain equation generally scales the matrix in the proper way to account for signal reflections. It is noted that the largest term in the matrix in one iteration may not be the largest term in the next iteration, i.e., the relative sizes of the terms change with each iteration, and thus there is not a one to one correspondence. Thus, the present invention uses a 0.8 value instead of 1 to allow flexibility. If a value of 1 was used in the equation, then the scaling may occasionally cause overflows, as mentioned above.

In the preferred embodiment, an additional scaling factor referred to as the secondary scaling factor is also applied to provide further scaling. In general, the predicting scaling factor of $$\frac{0.8}{1-k^2}$$

will not provide sufficient scaling to completely prevent a loss in precision. Thus the present invention intelligently monitors the matrix term results as they are stored and provides additional scaling with the secondary scaling factor.

The secondary scaling factor is generated as follows. The system of the present invention examines the most significant bits in each matrix term during the iterations. In a two's complement arithmetic implementation, the system examines the number of most significant bits that have all sign bits. If there are leading sign bits in the largest magnitude number, then the secondary scaling factor is generated to provide an additional shift. The secondary scaling factor is preferably the number of most significant bit that have all sign bits. It is noted that, when other arithmetic implementations are used, the secondary scaling factor may be generated in a different manner.

In the few cases where the new matrix terms are larger than the prior matrix terms after the iteration, the increase in value is prevented from causing an overflow by a guard bit which is always present. Therefore, the total predicted scaling factor generally operates to scale the data back to occupy all of the available significant bits. Thus as each matrix term is updated during an iteration, the matrix term is scaled prior to being stored.

It is noted that steps 306 and 308 may occur in either order or may occur during substantially the same computation. In the embodiment of FIG. 9, the scaling in step 308 is performed on the matrix terms after the iteration in step 306. Alternatively, scaling is performed prior to the iteration in step 306. Further, as discussed below with reference to FIG. 10, in one embodiment scaling is performed during the computation or the iteration.

After the predicted scaling factor is applied to the data or matrix terms, in step 310 the DSP 104 stores the data in the memory. Since the scaling was performed prior to storing the data, full precision data is stored. The matrix terms or data values are not required to be 16 bit values prior to storage, whereas only 16 bit values are stored in the memory. Thus, scaling the data prior to storage maintains a greater amount of precision in the data. In other words, the data values generally have many more bits of precision than what is actually stored. Since the data values are scaled prior to storage, the bits are maintained.

In prior art systems using a fixed point architecture, the data values are truncated and stored, and then the values are left shifted to scale the data back up. This results in a loss of precision since the left shift places zeros in the least significant bits. Alternatively, the data could be stored with double precision, requiring extra memory. In the present invention, the data is scaled prior to truncation and storage of the data, and thus full precision is maintained.

After the DSP 104 stores the data in the memory in step 310, in step 312 the DSP 104 determines if further iterations are required. If so, then operation returns to step 302, and a new reflection coefficient is computed. This operation repeats for each iteration on the matrices.

Figure 10:
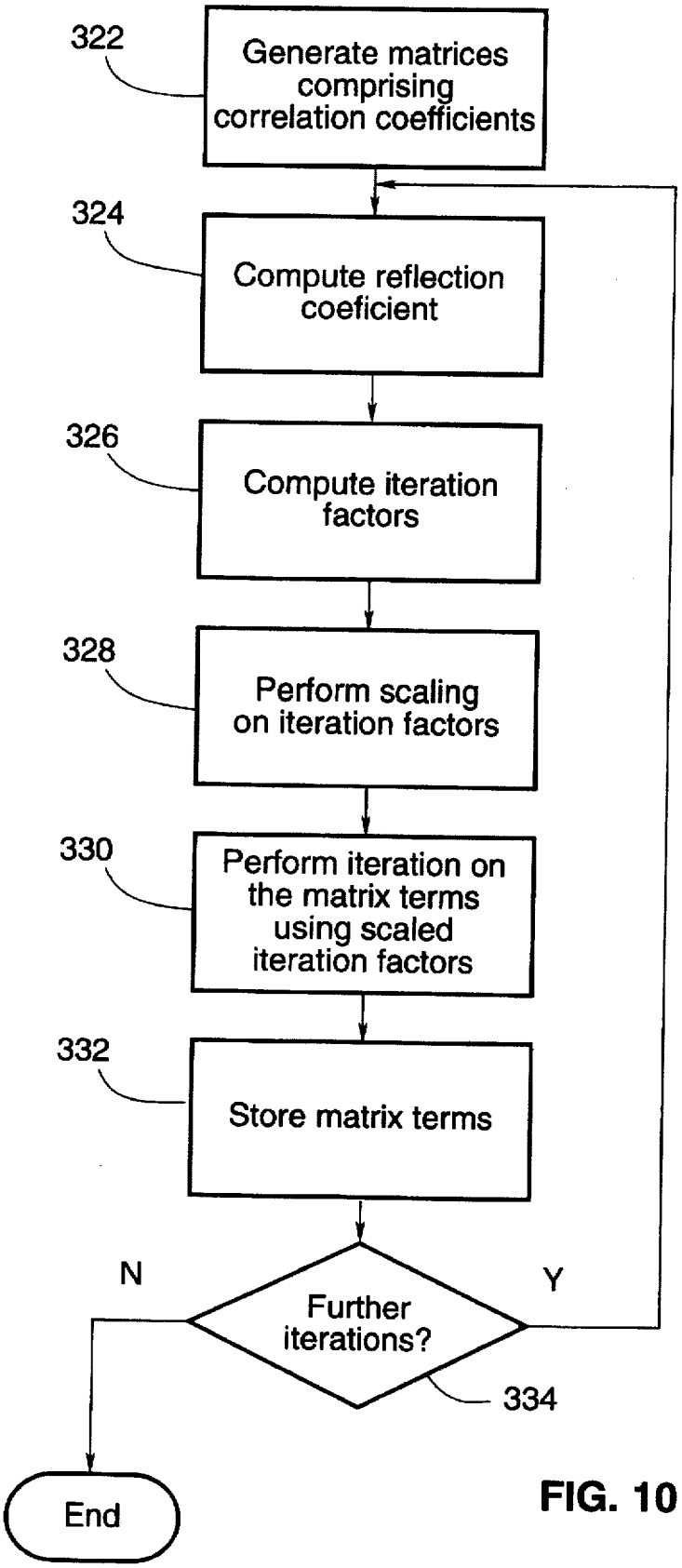
FIG. 10 is a flowchart diagram illustrating computation of lpc coefficients with increased precision according to an alternate and preferred embodiment of the present invention.

FIG. 10—Predictive Scaling Method (Preferred Embodiment)

Referring now to FIG. 10, a flowchart diagram is shown illustrating a portion of the voice coding process according to the preferred embodiment of the invention. The voice coding steps shown in FIG. 10 are similar to FIG. 9 described above. However, the method of FIG. 10 performs scaling on iteration factors that are multiplied by each matrix term during the iteration process. Thus the method of FIG. 10 performs scaling during the iteration process.

As described above with respect to FIG. 9, the flowchart of FIG. 10 illustrates only a portion of the steps performed in step 208 of FIG. 8, and other steps may be performed in step 208, as is known in the art. The flowchart of FIG. 10 comprises predicting a scale factor and performing the scaling during the matrix iterations and prior to storage of the data, thus producing data with increased precision.

In step 322 the DSP 104 computes one or more matrices comprising correlation coefficients for the voice or speech signal. The matrices are used for generating lpc coefficients which model the vocal tract, i.e., the acoustic effect of the mouth above the glottis. Each of the matrix terms comprise correlation coefficients. In the preferred embodiment, the DSP 104 computes three matrices referred to as F[i,k], C[i,k], and B[i,k], wherein F is referred to as a forward matrix, B is referred to as a backward matrix, and C is referred to as a current matrix.

In step 324 the DSP 104 computes a reflection coefficient referred to as k. As described in the background section, a widely used model for speech production assumes that the vocal tract can be represented as a concatenation of lossless acoustic tubes. The reflection coefficient represents the amount of traveling waves reflected at the junction of two tubes.

In step 326 the DSP 104 computes various iteration factors or multiplication factors that are used during the iteration. These iteration factors include a 1 value and values for k and $k^2$, as well as others. As an example, the iteration performed for the matrix terms of the F matrix is as follows:

$$F[i,k]=F[i,k]+kC[i,k]+kC[k,i]+k^2B[i,k]$$

wherein F[i,k] is the F matrix term, k is the reflection coefficient, and C[i,k] and B[i,k] are matrix terms from the C and B matrices, respectively. It is noted that similar iterations are preferably performed for updating matrix terms in the C[i,k] and B[i,k] matrices as well.

In step 328 the DSP 104 performs scaling on the iteration factors. The scaling operates to convert the iteration factors of 1, k, and $k^2$ to s, sk, and $sk^2$, wherein s is the total predicted scaling factor. Thus, in this embodiment, scaling is not directly performed on the matrix terms themselves, but rather is performed on the iteration factors that are then multiplied with the matrix terms. It is noted that performing scaling on the iteration factors, and then multiplying the scaled iteration factors with the matrix terms, operates to scale the matrix terms in the same way as if the matrix terms were scaled directly after unscaled iteration factors were multiplied by the matrix terms.

The DSP 104 performs scaling on the iteration factors using a predicted scaling factor. In the preferred embodiment, the scaling factor is $$\frac{.8}{1-k^2}.$$

However, it is noted that other predicted scaling factors may be used, as desired. The scaling factor may also be modified by a secondary scaling factor and a guard bit, as mentioned above. The predicted scale factor of $$\frac{0.8}{1-k^2}$$

ensures that the output values for the current iteration are only very rarely larger than those for the previous iteration.

As noted above, in the preferred embodiment an additional scaling factor referred to as the secondary scaling factor is also applied in certain instances to provide further scaling. Also, in the few cases where the new matrix terms values are larger than the prior matrix terms, the increase in value is prevented from causing an overflow by a guard bit which is always present. Therefore, the total predicted scaling factor generally operates to scale the data back to occupy all of the available significant bits.

In step 330 the DSP 104 performs an iteration on the respective matrix term(s) using the reflection coefficient and using the scaled iteration factors. This iteration involves updating the terms in each of the matrices to account for the reflection coefficient, as is known in the art, and as was described above. For example, the iteration for the F matrix uses the scaled iteration factors according to the equation:

$$F[i,k]=F[i,k]+skC[i,k]+skC[k,i]+sk^2B[i,k]$$

Similar iterations are performed for the other matrices using the scaled iteration factors. Thus the scaling is incorporated into the matrix update or matrix iteration for each matrix. Thus, in the embodiment of FIG. 10, the scaling is performed during the iteration or computation of each matrix term as the matrix term is updated during an iteration.

In step 332, after the iteration, wherein the predicted scaling factor has been applied, albeit indirectly, to the matrix terms, the DSP 104 stores the data in the memory. As noted above, in the present invention, the data is scaled prior to truncation and storage of the data, and thus full precision is maintained.

After the DSP 104 stores the data in the memory in step 332, in step 334 the DSP 104 determines if further iterations are required. If so, then operation returns to step 324, and a new reflection coefficient is computed. This operation repeats for each iteration on terms in the matrices.

Figure 11:
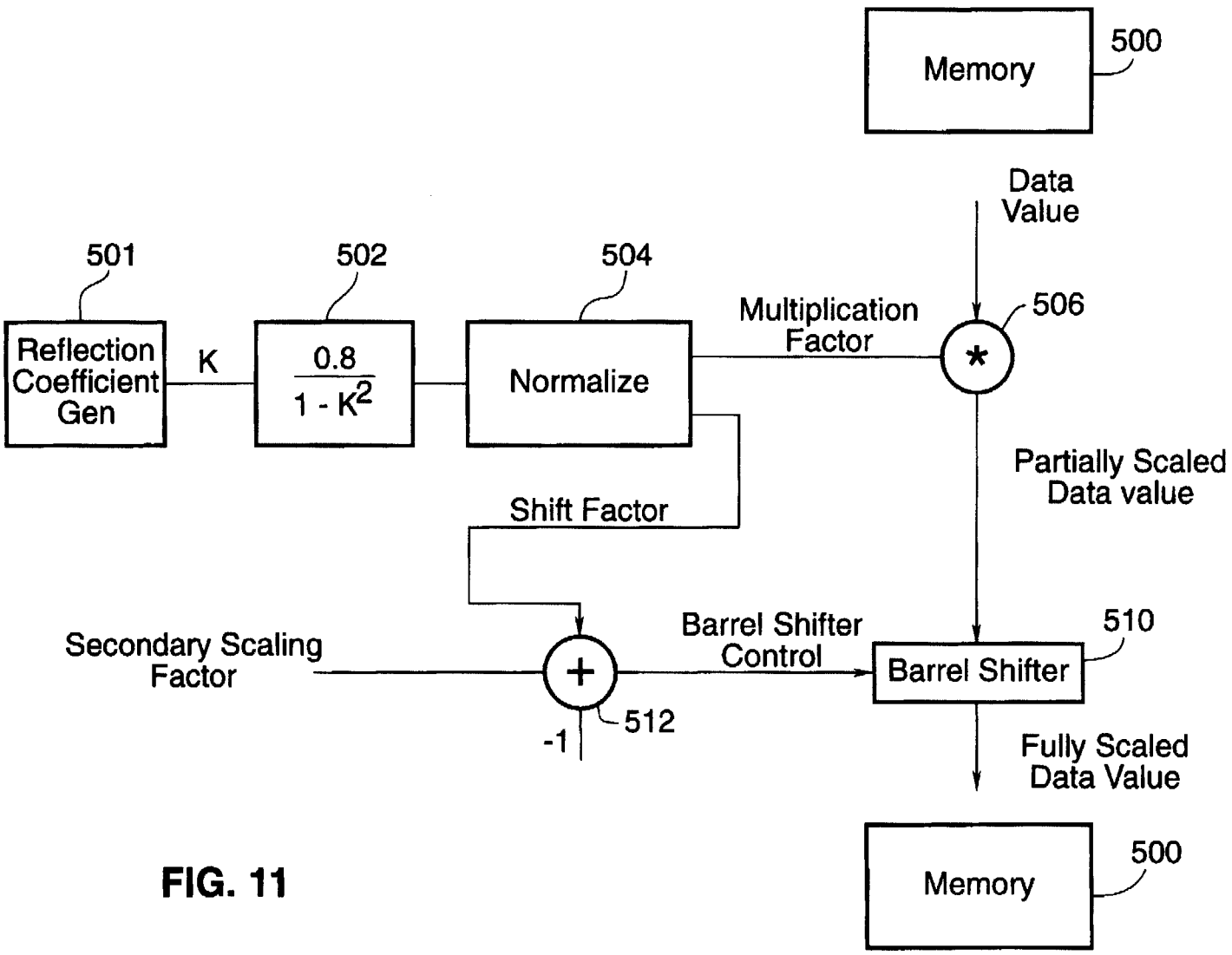
FIG. 11 illustrates a hardware block diagram for computing lpc coefficients with increased precision according to the preferred embodiment of the invention.

FIG. 11—Block Diagram

Referring now to FIG. 11, a block diagram illustrating hardware which generates lpc coefficients according to the preferred embodiment of the invention is shown. The hardware shown in FIG. 11 is a preferred embodiment for a fixed point implementation. It is noted that other system configurations may be used, as desired. The system of FIG. 11 performs scaling on matrix term data prior to storage according to the present invention. The system of FIG. 11 may perform scaling on the matrix terms themselves before or after the iteration, or may perform scaling on the matrix terms during the iteration computation. Also, the system of FIG. 11 may perform scaling on the iteration factors which are then multiplied with the matrix term data values during the iteration.

The system preferably includes a memory 500 which stores the matrix terms as well as any computed iteration factors. The system also preferably includes a means 501 for generating reflection coefficients. The means for generating reflection coefficients 501 is preferably the DSP 104 or the CPU 120. As shown, the reflection coefficient k is generated by the means 501 and is provided to block 502. Block 502 computes a gain or scaling factor according to the equation $$\frac{.8}{1-k^2}.$$

This gain is provided to a normalization block 504.

The normalization block or normalizer 504 produces a multiplication factor which corresponds to the gain between 0.5 and 1, and a shift factor value. Thus the normalization block 504 places the gain in a format where the gain is less than one (between 0.5 and 1) and includes a shift. For example, if the gain is 1.6, normalizing the gain produces a multiplication factor of 0.8 and a shift factor or fight shift of 1. The right shift of 2 places the 0.8 gain value or multiplication factor back to 1.6.

The multiplication factor output from the normalization block 504 is provided to a multiplication block or multiplier 506. The multiplier 506 also receives data values of the respective matrices from the memory 500. In other words, the matrix term data values are provided from the memory 500 to the multiplier 506. The multiplier 506 multiplies the multiplication factor with a respective data value from the memory 500, and the output of the multiplier 506 is a partially scaled data value, which is provided to barrel shifter 510.

It is noted that, in one embodiment, an iteration is performed on the matrix term data values prior to providing the matrix term values to the multiplier 506. Alternatively, the iteration is performed on the matrix term data values after scaling, i.e., after operation of the multiplier 506 and barrel shifter 510. In the preferred embodiment, as discussed above, the system of FIG. 11 performs scaling on iteration factors which are then multiplied by the matrix term data values, thus effectively scaling the matrix term data values. Thus, in the preferred embodiment, the multiplier 506 receives iteration factors from the memory 500, and scaling is performed on the iteration factors.

The shift value output from the normalization block 504 is provided to an adder 512. The adder 512 also receives a secondary scaling factor and a −1 value, referred to as a guard bit. The secondary scaling factor operates to provide an additional shift where a larger scaling factor than $$\frac{.8}{1-k^2}$$

is desired. In instances where the scaled matrix term value is larger than desired, i.e., too much scaling was performed, the increase in value is prevented from causing an overflow by the guard bit. The adder 512 outputs a barrel shifter control value to the barrel shifter 510. It is noted that each term of the matrices preferably has the same shift factor, multiplication factor, and secondary scaling factor.

The barrel shifter 510 shifts the partially scaled data value according to the barrel shifter control value and outputs a fully scaled data value. As noted above, in the preferred embodiment, the scaled data values output from the barrel shifter 510 comprise scaled iteration factors. In this embodiment, the scaled iteration factors are then used during the iteration and operate to scale the matrix term values during the iteration. In an embodiment where the matrix term values are directly scaled by the system of FIG. 11, the fully scaled matrix term values are then stored as 16 bit values, preferably in the memory 500. The fully scaled data values or matrix term values may also be stored in another memory, as desired.

It is noted that the overall output scaling factor comprises a multiplication value and a shift value. In many cases, a larger scaling factor than $$\frac{.8}{1-k^2}$$

can be used, and thus in some instances the data will be required to be left shifted after storage and bits of precision will be lost. Thus another scaling factor, referred to as the secondary scaling factor, is applied. The secondary scaling factor is added on to the shift factor such that, if a significant bit is free from the previous iteration, then the extra bit shift is performed by the barrel shifter 510 so that this extra bit of precision is also saved. This extra shift is the difference between the secondary scaling factor and the shift factor. The secondary scaling factor is the number of most significant bits that have all sign bits, and the shift factor is the power of 2 that is derived from the scaling factor equation of $$\frac{.8}{1-k^2}.$$

The following example explains the operation of the shift. Consider an example where k=0.95, then $$\frac{0.8}{1-k^2}=8.205$$

This is decomposed into a multiplication by 0.5128 and a shift to the left by 4 bits. (A left shift of 4 is equivalent to multiplying by $2^4$=16.). The shift is then increased by the secondary shift factor value, which is equal to the number of unused most significant digits in the largest magnitude number output on the previous iteration. Finally, a 1 value, referred to as the guard bit, is subtracted from the shift value to produce a total overall shift This reduction by 1 is designed to prevent overflows.

As noted above, in the preferred embodiment, the system of FIG. 11 performs scaling on iteration factors stored in the memory 500. In this embodiment, the iteration factors are provided from the memory 500 to the multiplier 506, and then to the barrel shifter 510, thus scaling the iteration factors. The scaled iteration factors are then multiplied with the matrix term values. Multiplication of the matrix term values with the scaled iteration factors effectively operates to scale the matrix term values just as if the scaling was performed directly on the matrix term values.

Figure 12:
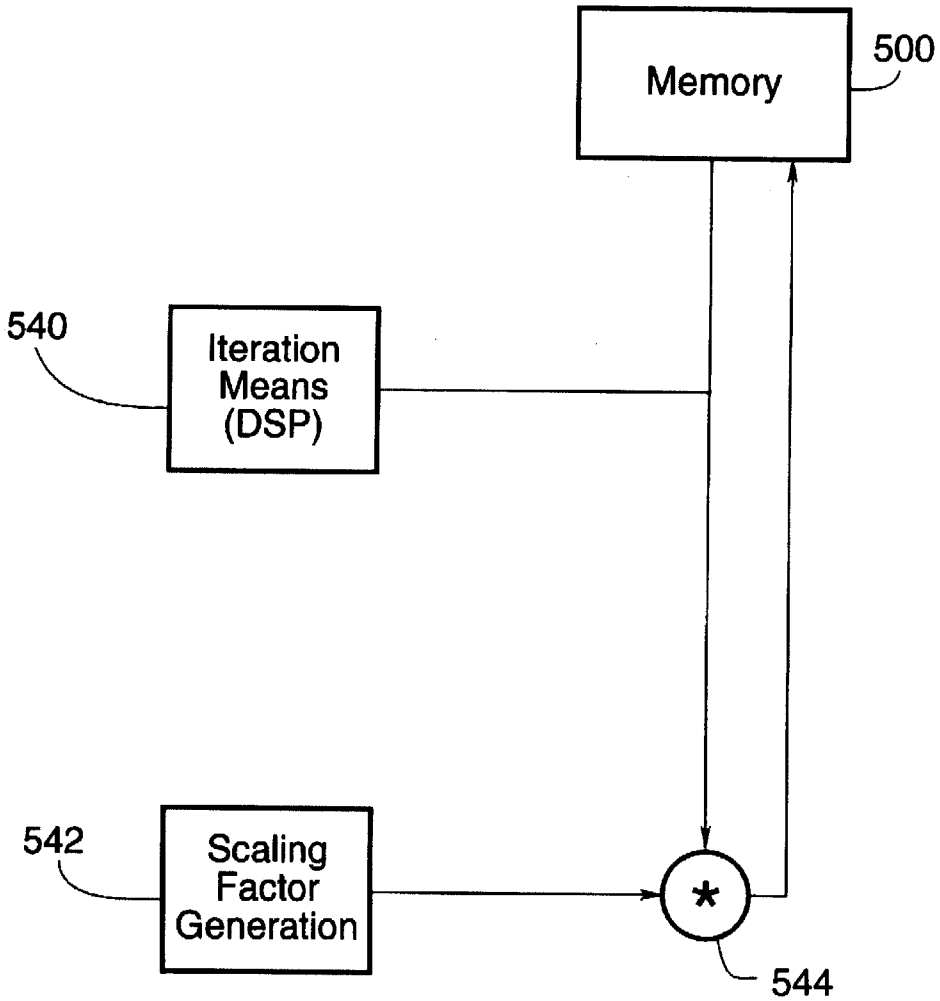
FIG. 12 illustrates a simplified hardware block diagram for computing lpc coefficients with increased precision according to the present invention.

FIG. 12—Simplified Block Diagram

FIG. 12 illustrates a simplified block diagram of a representative system which performs predictive scaling according to the present invention. As shown, the system of FIG. 12 includes memory 500 which stores matrix term data values as well as computed iteration factors. An iteration means 540 is included which receives matrix term data values from the memory 500 and performs iterations on the matrix term values. The iteration means 540 is preferably the DSP 104, or may be dedicated logic, as desired.

The system also includes a scaling factor generation block 542 which generates the total scale factor applied to the data. The scaling factor generation block 542 preferably includes the block 502 (FIG. 11), and also takes into account the secondary scaling factor and the guard bit.

The system of FIG. 12 further includes multiplier 544 which multiplies the total scaling factor with the data values. The multiplier 544 multiplies the total scaling factor with preferably either the matrix term data values or with the iteration factors, as discussed above. The multiplier 544 preferably includes the multiplier 506 as well as the barrel shifter 510 of FIG. 11.

Therefore, FIG. 12 illustrates a more simplified block diagram of the logic of FIG. 11 which performs predictive scaling according to the present invention.

Conclusion

Therefore a system and method for performing lpc coding with increased precision is shown and described. The system and method of the present invention predicts a scaling factor and performs scaling of the matrix term data prior to storing the data, thus maintaining greater precision.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A method for generating linear predictive coding filter coefficients in response to a received voice signal waveform, comprising:

receiving a voice signal waveform;

generating one or more matrices comprising a plurality of terms, wherein said matrix terms comprise correlation coefficients, wherein said one or more matrices are generated in response to said received voice signal waveform;

computing a reflection coefficient based on said received voice signal waveform;

performing an iteration on said terms in said one or more matrices using the reflection coefficient, wherein said iteration operates to reduce values of a plurality of said correlation coefficients in said one or more matrices;

scaling said plurality of terms in said one or more matrices, wherein said scaling operates to increase the values of said plurality of terms in said one or more matrices to at least partially offset said reduction in values that occurs in said performing an iteration;

storing said plurality of matrix terms in a memory using a fixed number of data bits after said performing an iteration and after said scaling;

repeating said steps of computing a reflection coefficient, performing an iteration, scaling said plurality of terms, and storing said plurality of matrix terms for a plurality of times to generate said linear predictive coding filter coefficients; and generating a parametric representation of said voice signal waveform, wherein said parametric representation of said voice signal waveform includes said linear predictive coding filter coefficients.

2. The method of claim 1, wherein said performing scaling on said plurality of matrix terms comprises multiplying said plurality of matrix terms by a predicted scaling factor.

3. The method of claim 1, wherein said performing scaling on said plurality of matrix terms comprises multiplying said plurality of matrix terms by $$\frac{0.8}{1-k^2},$$

wherein k is the reflection coefficient, and wherein $$\frac{0.8}{1-k^2}$$

is said predicted scaling factor.

4. The method of claim 1, wherein said scaling said plurality of terms in said one or more matrices occurs during said performing an iteration on said one or more matrices.

5. The method of claim 4, wherein said performing an iteration on said one or more matrices comprises multiplying each of said plurality of matrix terms by one or more iteration factors;

wherein said scaling said plurality of terms in said one or more matrices comprises scaling each of said iteration factors prior to said multiplying each of said plurality of matrix terms by said one or more iteration factors.

6. The method of claim 1, wherein said performing scaling on said plurality of matrix terms comprises:

generating a multiplication factor and a shift factor;

multiplying each of said plurality of matrix terms by said multiplication factor to produce partially scaled data values;

generating a secondary scaling factor, wherein said secondary scaling factor provides additional scaling; and shifting each of said partially scaled data values by a number of bits indicated by said shift factor and said secondary scaling factor.

7. The method of claim 6, wherein said secondary scaling factor is a number of unused most significant bits in the matrix term having the largest magnitude on the previous iteration.

8. The method of claim 6, wherein said shifting each of said partially scaled data values further comprises shifting each of said partially scaled data values by a number of bits which include a guard bit value, wherein said guard bit value operates to reduce said shifting for each of said partially scaled data values, wherein said guard bit value operates to prevent an overflow of said plurality of matrix terms during said scaling.

9. The method of claim 1, wherein each said plurality of matrix terms comprises data values having a first number of significant bits, wherein said storing said plurality of matrix terms comprises storing said plurality of matrix terms using a second number of significant bits, wherein said second number is less than said first number.

10. The method of claim 1, wherein said stored plurality of matrix terms have a substantially full precision.

11. A system for generating linear predictive coding coefficients in response to a received speech signal waveform, comprising:

a memory for storing matrix term data values corresponding to one or more matrices;

an iteration means which performs iterations on said matrix term data values corresponding to said one or more matrices to generate linear predictive coding coefficients;

a scaling factor generation block including an input for receiving a reflection coefficient, wherein said scaling factor generation block generates a scaling factor in response to said received reflection coefficient;

a multiplier which receives said matrix term data values of said one or more matrices and which receives said scaling factor from said scaling factor generation block, wherein said multiplier multiplies said matrix term data values with said scaling factor to produce scaled data values;

wherein said memory stores said scaled data values after operation of said multiplier;

wherein said system is operable to generate a parametric representation of said speech signal waveform, wherein said parametric representation of said speech signal waveform includes said linear predictive coding filter coefficients.

12. The system of claim 11, wherein said scaling factor generation block generates a predicted scaling factor;

wherein said multiplier multiplies data values from each of said plurality of terms in said one or more matrices with said predicted scaling factor to produce scaled data values.

13. The system of claim 11, wherein said scaling factor is $$\frac{0.8}{1-k^2},$$

wherein k is the reflection coefficient.

14. The system of claim 11, wherein said multiplier is comprised in said iteration means.

15. A system for generating linear predictive coding coefficients in response to a received speech signal waveform, comprising:

a gain generation block including an input for receiving a reflection coefficient and which generates a gain in response to said received reflection coefficient;

a normalization block coupled to an output of said gain generation block, wherein said normalization output produces a multiplication factor and a shift factor;

a multiplier which receives data values of said plurality of terms of said one or more matrices and which receives said multiplication factor from said normalization block, wherein said multiplier multiplies data values from each of said plurality of terms in said one or more matrices with said multiplication factor to produce a partially scaled data value;

an adder which receives said shift factor value output from said normalization block and which produces a control signal;

a barrel shifter for receiving said partially scaled data value, wherein said barrel shifter further includes a control input which receives said control signal from said adder and shifts said partially scaled data value according to said barrel shifter control signal to produce a substantially fully scaled data value; and a memory for storing said fully scaled data value;

wherein said system is operable to generate a parametric representation of said speech signal waveform wherein said parametric representation of said speech signal waveform includes said linear predictive coding filter coefficients.

16. The system of claim 15, wherein said adder further receives a secondary scaling factor input, wherein said adder produces said control signal in response to said received shift factor value and said secondary scaling factor input.

17. A method for generating linear predictive coding filter coefficients in response to a received voice signal waveform, comprising:

receiving a voice signal waveform;

generating one or more matrices comprising a plurality of terms, wherein said matrix terms comprise correlation coefficients, wherein said one or more matrices are generated in response to said received voice signal waveform;

computing a reflection coefficient based on said received voice signal waveform;

computing one or more iteration factors using said reflection coefficient;

scaling said one or more iteration factors;

performing an iteration on said terms in said one or more matrices using the reflection coefficient and said one or more iteration factors;

wherein said iteration generally operates to reduce values of a plurality of said correlation coefficients in said one or more matrices, wherein said scaling said one or more iteration factors operates to increase the values of said plurality of terms in said one or more matrices to at least partially offset said reduction in values that occurs in said performing an iteration;

storing said plurality of matrix terms in a memory using a fixed number of data bits after said performing an iteration and after said scaling;

repeating said steps of computing a reflection coefficient, computing one or more iteration factors, scaling said one or more iteration factors, performing an iteration, and storing said plurality of matrix terms for a plurality of times to generate said linear predictive coding filter coefficients; and generating a parametric representation of said voice signal waveform, wherein said parametric representation of said voice signal waveform includes said linear predictive coding filter coefficients.

* * * * *